United States Patent [19]

Gilbert

[11] Patent Number: 4,476,538

[45] Date of Patent: Oct. 9, 1984

[54] TRIGONOMETRIC FUNCTION GENERATOR

[75] Inventor: Barrie Gilbert, Forest Grove, Oreg.

[73] Assignee: Analog Devices, Inc., Norwood, Mass.

[21] Appl. No.: 344,544

[22] Filed: Feb. 1, 1982

[51] Int. Cl.[3] ..... G06G 7/22

[52] U.S. Cl. ..... 364/817; 307/498; 364/850; 364/851

[58] Field of Search ..... 364/815, 816, 817, 818, 364/850, 603, 851, 856, 607, 608; 307/490, 498, 260; 328/142, 161, 14; 340/347 SY

[56] References Cited

U.S. PATENT DOCUMENTS

| | | | |
|---|---|---|---|
| 3,493,735 | 2/1970 | Heaviside et al. | 364/817 X |
| 3,646,337 | 2/1972 | Bifulco, Jr. | 364/817 |
| 3,984,672 | 10/1976 | Jones | 364/817 |
| 4,138,729 | 2/1979 | Bayer et al. | 364/603 |
| 4,335,443 | 6/1982 | Dickey | 364/817 X |

*Primary Examiner*—Joseph F. Ruggiero
*Attorney, Agent, or Firm*—Parmelee, Bollinger & Bramblett

[57] ABSTRACT

A universal trigonometric function generator which is selectively programmable by pin-strapping to generate any of the standard trigonometric functions (sine, cosine, tangent, cotangent, secant and cosecant). The circuit includes two identical sine-function generating networks each of which produces an output signal proportional to the sine of a corresponding angle input. These networks are so interrelated that the composite output signal is proportional to the angle input of one network and inversely proportional to the angle input of the other network, producing an output $$A\frac{\sin(\theta_1-\theta_2)}{\sin(\phi_1-\phi_2)},$$

where A is a controllable amplitude, $\theta_1-\theta_2$ is the angle input to one network, and $\phi_1-\phi_2$ is the angle input to the other network. By selectively connecting the input terminals for $\theta_1$, $\theta_2$, $\phi_1$, $\phi_2$ to an angle control signal and reference voltages corresponding to 0° and 90°, any one of the standard trigonometric functions can be generated.

13 Claims, 11 Drawing Figures

SINE-SYNTHESIS NETWORK. THE PREFERRED CIRCUIT HAS 6 TRANSISTORS, R=500 OHMS, I-150μA AND HAS ANGULAR RANGE OF ± 360°.

BASIC 'SINE' MODE

BASIC 'COSINE' MODE

ANGULAR RANGE IN COSINE MODE

BASIC TANGENT CONNECTIONS

TRIGONOMETRIC FUNCTION GENERATOR

BACKGROUND OF THE INVENTION

1. Field of the Invention

This invention relates to an electrical circuit for generating an output signal corresponding to a trigonometric function of an angle input signal. More particularly, this invention relates to a circuit which can selectively generate any of the standard trigonometric functions: sine, cosine, tangent, cotangent, secant and cosecant.

2. Description of the Prior Art

A wide variety of techniques have been developed to generate trigonometric functions using analog circuitry. For example, prior techniques for generating sinusoidal functions include piecewise linear approximations, polynomial and other continuous function techniques using multipliers, special translinear circuits, simple modifications of bipolar-transistor differential amplifiers, and circuits comprising large numbers of such differential amplifier stages connected in periodic antiphase.

In general, previous approaches depend on using specialized circuits for each trigonometric function. Thus, quite different techniques are normally employed for generating the sine function and the tangent function. Methods for generating the reciprocal functions (cotangent, secant and cosecant) are rarely described.

SUMMARY OF THE INVENTION

In a preferred embodiment of the invention to be described in detail hereinafter, a single circuit is used to generate all of the standard trigonometric functions (sine, cosine, tangent, cotangent, secant and cosecant) with excellent accuracy and temperature stability. This circuit includes two identical sine-function generating networks which produce output signals proportional to the sine of an angle input. These networks are so interrelated that the composite output signal is proportional to the angle input of one network and inversely proportional to the angle input of the other network. Thus the output signal is $$A\frac{\sin(\theta_1-\theta_2)}{\sin(\phi_1-\phi_2)},$$

where A is a controllable amplitude, $\theta_1-\theta_2$ is the angle input to one network, and $\phi_1-\phi_2$ is the angle input to the other network. By selectively connecting the network input terminals with an angle control signal and reference voltages representing 0° and 90°, any of the standard trigonometric functions can be generated, depending only upon pin-strapping to select the desired trigonometric function.

FIGS. lOA and lOB together present a detailed schematic of the commercial device.

DETAILED DESCRIPTION OF A PREFERRED EMBODIMENT

Figure 1:
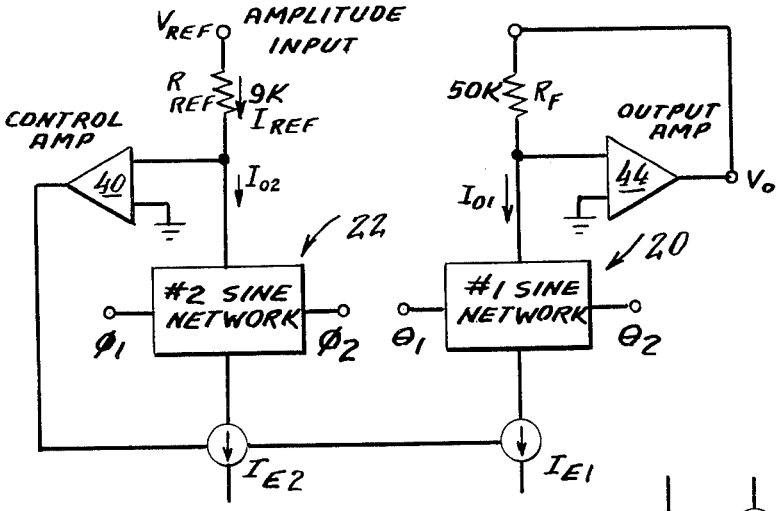
FIG. 1 is a block diagram illustrating the overall arrangement of a trigonometric function generator.
Figure 2:
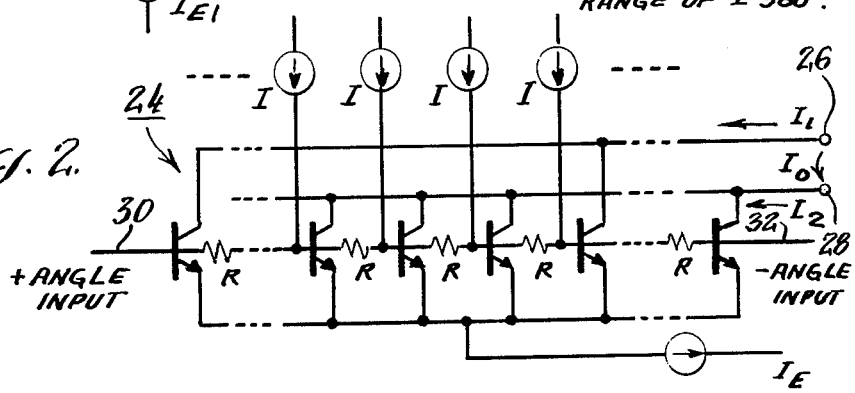
FIG. 2 is a circuit diagram showing a preferred type of sine-function generating network.

Referring now to FIG. 1, the trigonometric function generator in accordance with this invention comprises a pair of sine networks 20, 22 arranged to receive respective differential input signals $\theta_1$, $\theta_2$; $\phi_1$, $\phi_2$, and to produce output signals $I_{o1}$ and $I_{o2}$ corresponding to the sine of the angles represented by those input signals. These sine networks advantageously are in accordance with the disclosure of copending application Ser. No. 344,543, filed by the present inventor on Feb. 1, 1982. FIG. 2 hereof illustrates such a sine network 24 which preferably includes six matched transistors, five interbase resistors R, and four equal current sources I driving the nodal points of the resistor network.

The current of a common emitter source $I_E$ is divided into the six transistors of the network 24, and the transistor collectors are connected in alternating antiphase to develop currents $I_1$ and $I_2$ at a pair of output terminals 26, 28. The sum of $I_1$ and $I_2$ is $I_E$. The difference between $I_1$ and $I_2$ is the output current of the network $I_o$. A differential angle input signal is applied at the end terminals 30, 32 of the network to control the output differential current $I_o$ in accordance with the sine of the input angle.

Figure 3:
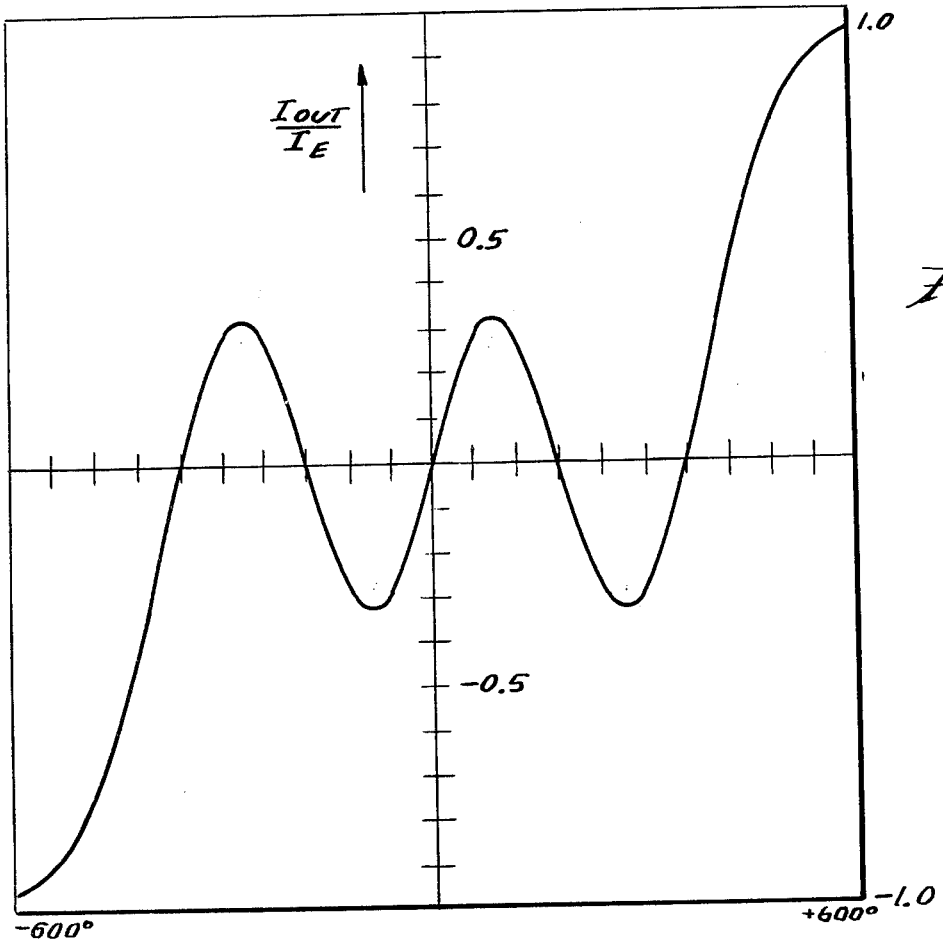
FIG. 3 is a graph illustrating the sine-function generated by the network of FIG. 2.

FIG. 3 shows the output of the network 24 as a function of the angle input signal. It will be seen that the output current varies sinusoidally, with very high accuracy over a range well beyond the ±90° limit of most conventional devices. Within the central ±180°, the error is less than 0.25%. Within a range of ±270°, the circuit has an error less than 1%.

Referring again to FIG. 1, a high-gain control amplifier 40 receives the output current $I_{o2}$ of the $\phi$ sine network 22 together with a reference current supplied through a resistor $R_{REF}$ connected to a reference voltage terminal $V_{REF}$(1.8 V in the preferred embodiment). The output of the amplifier 40 controls the current source $I_{E2}$ to make $I_{o2}$ equal to the reference current. The other emitter current source $I_{E1}$ is matched to $I_{E2}$ and is slaved to that source by common connections. Thus the $\theta$ network 20 receives the same emitter current as the $\phi$ network.

In considering the overall circuit operation, the following conventions will be used: $\theta_1$ and $\theta_2$ are angles proportional to the input voltages applied to the respective input terminals of the $\theta$ network, and $\phi_1$ and $\phi_2$ are angles proportional to the input voltages applied to the respective input terminals of the $\phi$ network. Now, applying the analysis developed for such sine networks in the above-identified copending application, the output current of the $\theta$ network is:

$$I_{o1}=C_1\,I_{E1}\sin(\theta_1-\theta_2) \qquad (1)$$

where $C_1$ is a temperature dependent factor determined by the network design.

This differential current $I_{o1}$ is converted by the high-gain output amplifier 44 and its feedback resistance $R_F$ into an output voltage:

$$V_o = C_1 I_{E1} R_F \sin(\theta_1 - \theta_2) \quad (2)$$

In a similar fashion, the output current of the $\phi$ network is:

$$I_o = C_2 I_{E2} \sin(\phi_1 - \phi_2) \quad (3)$$

The feedback loop including the control amplifier 40 is in balance when $I_{o2} = I_{REF} = V_{REF}/R_{REF}$. Thus:

$$V_{REF} = C_2 I_{E2} R_{REF} \sin(\phi_1 - \phi_2) \quad (4)$$

Since the $\phi$ and $\theta$ networks are identical, $C_1 = C_2$, and since $I_{E1}$ is equal to $I_{E2}$, equations (2) and (4) can be combined to give:

$$V_o = V_{REF} \frac{R_F}{R_{REF}} \cdot \frac{\sin(\theta_1 - \theta_2)}{\sin(\phi_1 - \phi_2)} \quad (5)$$

or $$V_o = A \frac{\sin(\theta_1 - \theta_2)}{\sin(\phi_1 - \phi_2)}$$

This shows that the output voltage $V_o$ of the circuit of FIG. 1 is proportional to the product of an amplitude factor (A) and the sine of the difference in angles $\theta_1$ and $\theta_2$, and inversely proportional to the sine of the difference in angles $\phi_1$ and $\phi_2$. It should also be noted that the temperature dependence of a single sine network has been eliminated in the combined circuit, as a result of the inverse relationship of the two networks. The resulting overall circuit provides a basic building block from which all of the trigonometric functions can be derived, as will be explained hereinafter.

Figure 4:
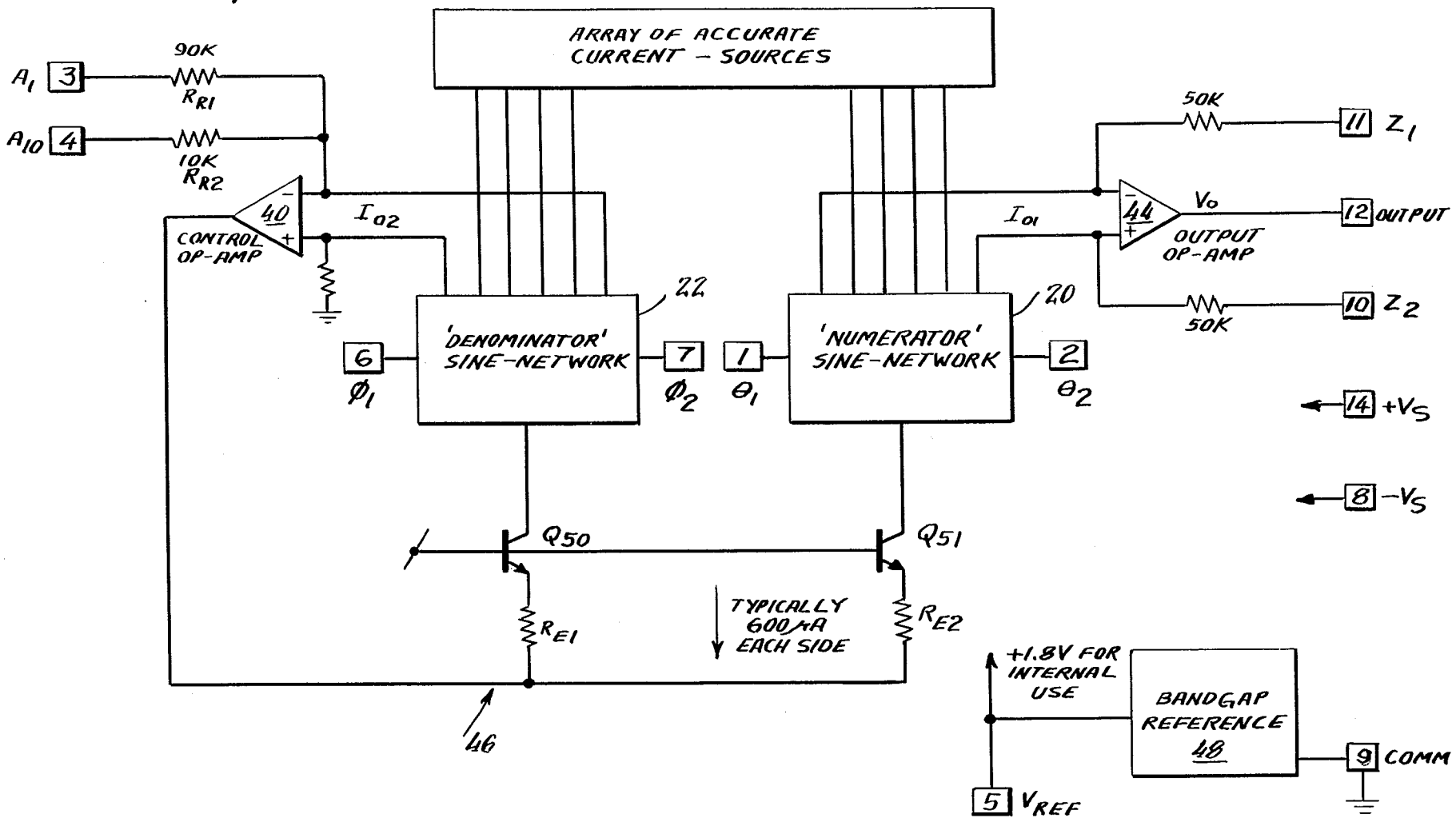
FIG. 4 is a block diagram showing certain aspects of a commercial version of the trigonometric function-generator, with pin-out connection points indicated.

FIG. 4 shows further aspects of a commercial version of the circuit, and identifies pin connection points for subsequent reference. Here the control amplifier 40 receives a reference current from one or both of two reference resistors $R_{R1}$, $R_{R2}$ in accordance with whether the desired output amplitude is 1 volt or 10 volts. The output of the amplifier controls the voltage on a line 46 connected in common to the emitter resistors $R_{E1}$, $R_{E2}$ of a pair of matched current source transistors Q50, Q51 having their bases interconnected. Thus the second current source is slaved to the first source Q50.

The commercial circuit includes a reference voltage generator indicated by a block 48. This generator may for example be a temperature-stabilized band-gap reference as disclosed in U.S. Pat. No. Re. 30,586. With pins 3 and 4 strapped to pin 5 of the reference voltage generator, and with $V_{REF} = 1.8$ V, approximately 200 $\mu$A is supplied through resistors $R_{R1}$, $R_{R2}$ to the amplifier input. The output of the control amplifier sets the voltage of line 46 to force the current source Q50 to supply the emitter current $I_E$ needed to produce 200 $\mu$A as the output current from the network, so as to balance the amplifier input. In the commercial version of this circuit, with a 90° angle input signal (1.8 volts) across the input terminals $\phi_1$, $\phi_2$, the source Q50 would produce a current $I_E$ of about 600 $\mu$A, corresponding to a ratio of about $\frac{1}{3}$ for $I_o/I_E$, as indicated by FIG. 3 for a 90° input angle.

The second current source Q51 tracks the first current source Q50, and also produces the same 600 $\mu$A as the emitter current $I_E$ for the $\theta$ network 20. Thus if a 90° signal (1.8 V) is applied across its input terminals $\theta_1$, $\theta_2$, a 200 $\mu$A differential current would be produced as the network output $I_{o1}$. With a 50K feedback resistor $R_F$ for the output amplifier 44, this current produces a 10 volt output signal $V_o$.

Figure 5:
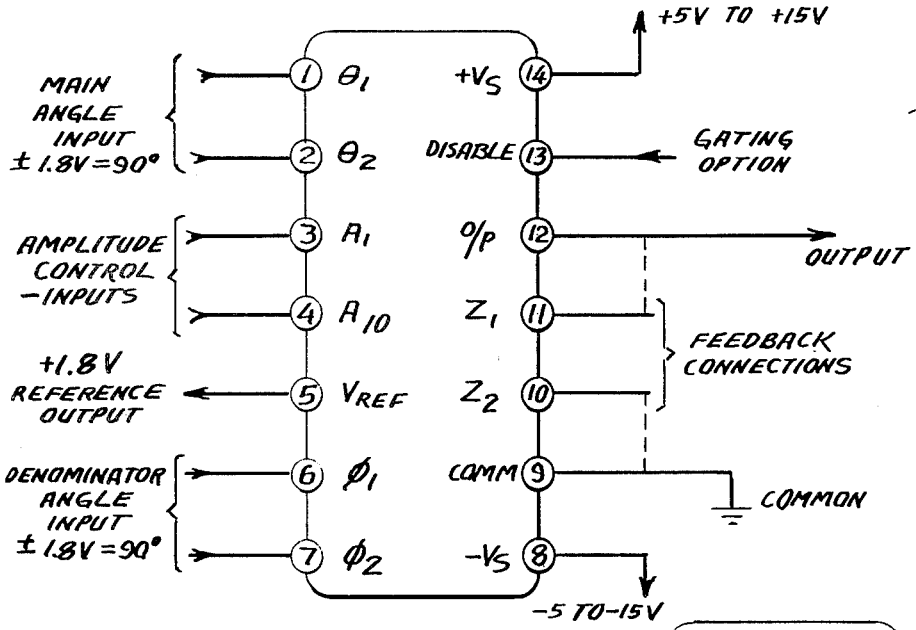
FIG. 5 is a diagrammatic showing of the basic pin-out arrangement for the commercial version.

FIG. 5 shows diagrammatically the pin-out arrangement for one commercial version of the circuit adapted to a 14-pin DIP package. This basic diagram is used in FIGS. 6, 7 and 9 to illustrate how the pin-strapping connections are made to program the circuit for the sine, cosine, and tangent modes respectively.

Figure 6:
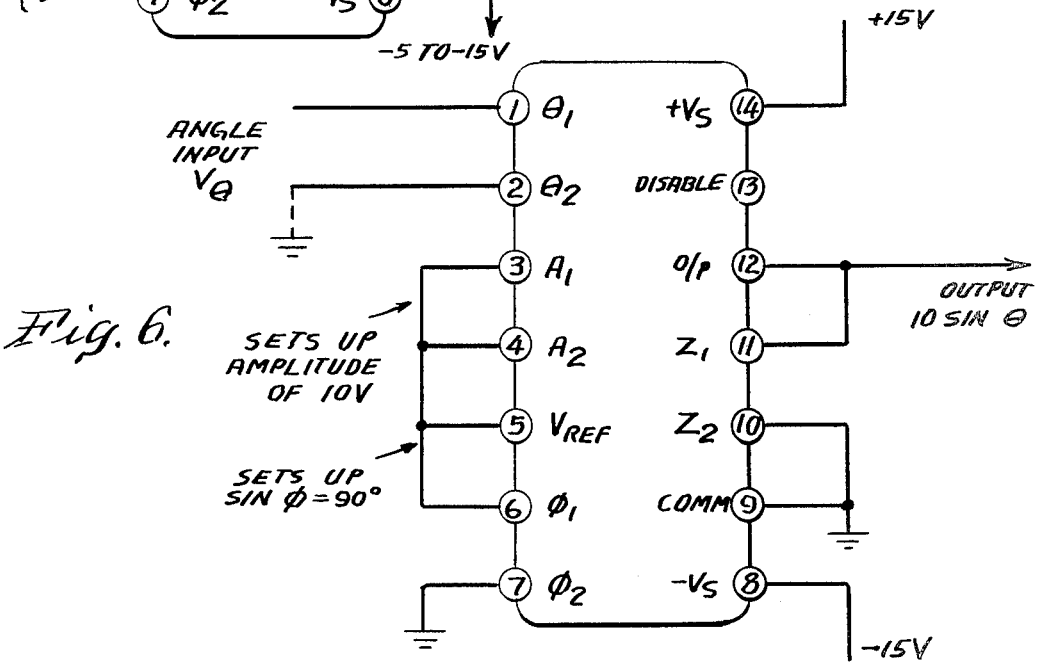
FIG. 6 shows the pin-strapping connections for the sine mode.

Referring now to FIG. 6, it will be seen that the basic sine mode is programmed by connecting $V_{REF}$ to $\phi_1$ to apply an input angle of 90° to the $\phi$ network 22, so that the denominator in equation 5 is unity. $V_{REF}$ also is connected to $A_1$, $A_2$ to set up an output amplitude of 10 volts. The angle control signal is connected to the $\theta_1$ pin, with $\theta_2$ being grounded, so that the output is proportional to $\sin(\theta - 0)$. The output terminal O/P therefore will develop the sine function as shown in FIG. 3.

Figure 7:
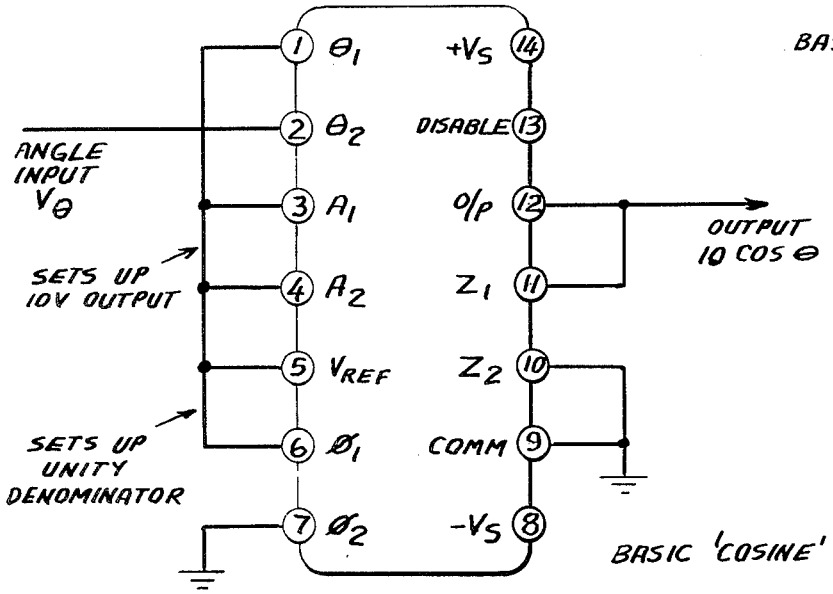
FIG. 7 shows the pin-strapping connections for the cosine mode.
Figure 8:
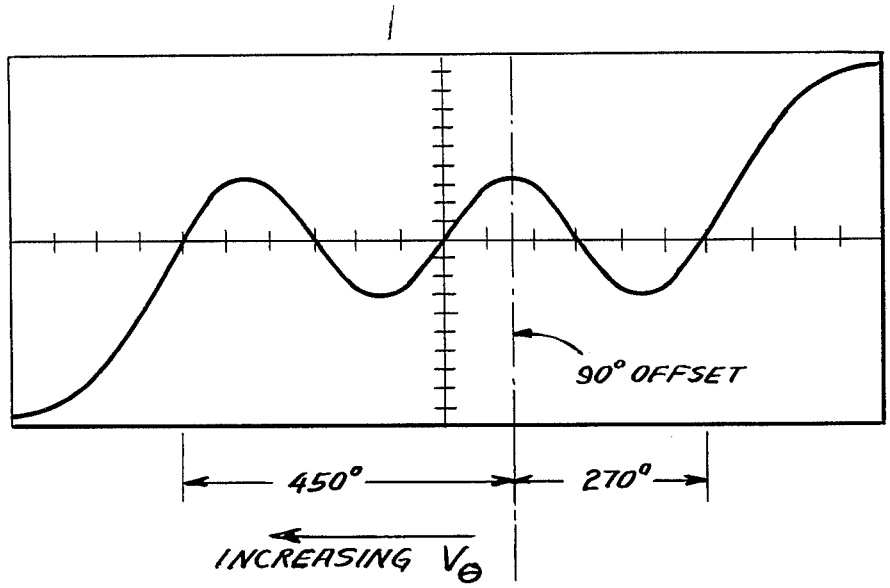
FIG. 8 is a graph showing the output variation for the cosine connection.

Pin-strapping for one cosine mode is shown in FIG. 7. This is the same as FIG. 6 except that the angle control signal is applied to the $\theta_2$ pin, while the fixed 90° reference voltage is connected as $\theta_1$. Thus the network is programmed for $\sin(90° - \theta_2)$, which is equivalent to $\cos\theta_2$. FIG. 8 shows the cosine function, together with the 90° offset line. Positive values of $\theta$ cover a range of 450°, and negative values cover a range of 270°. The cosine function also can be set up by connecting $V_{REF}$ as $\theta_2$ and the control signal as $\theta_1$; in that way, positive values of $\theta_1$ would cover a range of 270°, and negative values would cover a range of 450°.

Figure 9:
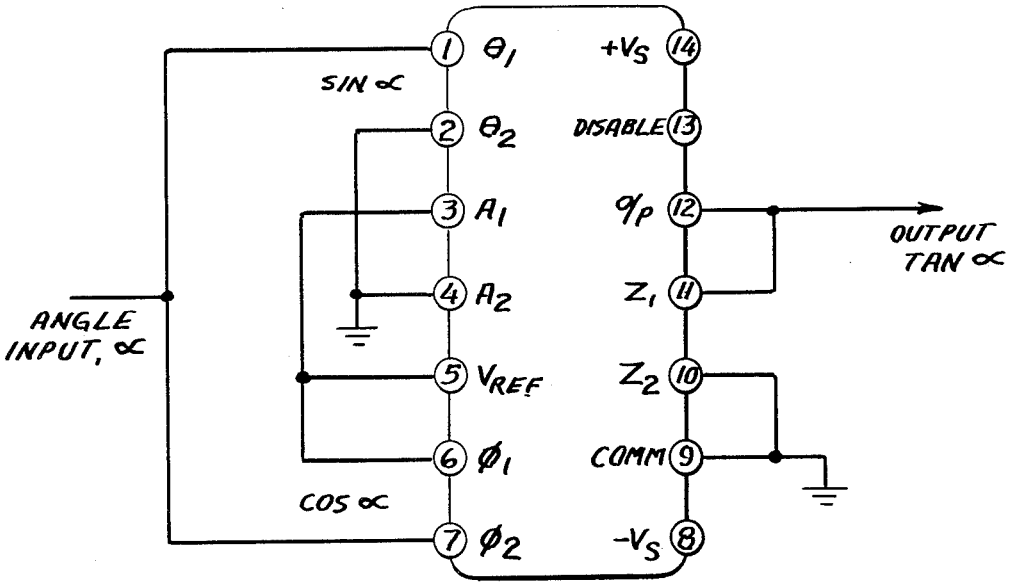
FIG. 9 shows the pin-strapping connections for the tangent mode.

The tangent mode is shown in FIG. 9. Here $V_{REF}$ again is connected to $\phi_1$ and $\theta_2$ is grounded, as in the sine mode. However, now the control signal for an angle $\alpha$ is applied to both the $\theta_1$ and the $\phi_2$ pins. Thus the output is proportional to $$\frac{\sin(\alpha - 0°)}{\sin(90° - \alpha)} = \frac{\sin\alpha}{\cos\alpha} = \tan\alpha$$

FIG. 9 shows a $V_{REF}$ connection to $A_1$, with $A_2$ being grounded.

There are only certain valid regions of operation in the tangent mode, corresponding to the correct feedback phase around the control amplifier. This results in the main range being from −90° to +90° (where $\cos\phi$ is positive); secondary ranges occur from −360° to −270° and 270° to 360°. The output with the connections shown is +1 V at 45°, rising to +1O V at +84.29° (and −1O V at −84.29°). The sign of the output can be reversed by reversing $\theta_1$ and $\theta_2$. There may be some cases where the user would want to select the 1O V scaling option ($A_1$ and $A_2$ both connected to $V_{REF}$). This causes the output to rise from 0 at 0°, through 1 V at 5.71° and 1O V at 45°.

Very similar considerations apply to the cotangent mode. The input angle signal ($\alpha$) is applied to both $\theta_2$ and $\phi_1$, with $\phi_2$ grounded, and $\theta_1$ set at 90° ($V_{REF}$). The main region of operation is from 0° to 180° (the output is zero at 90°); secondary ranges occur from −270° to −90° and 270° to 360°.

The cosecant function (the reciprocal of the sine function) is generated by applying the angle input to the $\phi$ network and setting the $\theta$ network to unity by making $\theta = +90°$. The sign of the denominator function must be positive to maintain the right feedback sense in the control amplifier. Thus, the primary angular range extends from 0 to +180°. The unity amplitude input $A_1$ is used, since the cosecant function never has a magnitude less than 1. Using the 1 V scaling option, the output is +1O V at 5.74° and +174.26°. The negative output (−cosec $\phi$) is obtained by reversing the inputs to $\theta_1$ and $\theta_2$.

Similar considerations of range apply to the secant mode (the reciprocal of the cosine). The angle input is offset by 90° to set up the cosine mode in the $\phi$ network, and the $\theta$ network is set up to sin 90°=1 by use of the reference voltage. The primary region of operation is from −90° to +90°. The $A_1$ amplitude option is used, so that the output is +1 V at 0° and rises to 1O V at ±84.26°. The function of −sec $\phi$ can be generated by simply reversing the $\theta$ inputs.

The feedback around the output amplifier 44 may be broken (as indicated in FIG. 5), leaving the $Z_1$ and $Z_2$ terminals available as another input. Now, the net input to the output amplifier is the difference between the output from the sine networks (Asin $\theta$/sin $\phi$) and ($Z_1-Z_2$). If the amplifier output is connected back to the angle inputs, inverse-function operations can be developed. For example, to develop arctan, the inputs are set up as for the tangent and scaled according to the application (but probably using the 1 V scale). The composite output from the sine networks (i.e. the tangent output) is nulled using the $Z_1-Z_2$ input, and the amplifier 44 forces the angle input signal to be equal to that corresponding to this input. It will be necessary in at least certain of the inverse-function arrangements to use ancillary signal-controlling devices, such as means to limit the input signal magnitude, and a disconnect diode as when using a multiplier in the square-root mode.

FIGS. lOA and lOB together present a schematic diagram of the present design of a commercial trigonometric function generator which is provided on a single IC chip. The design shown includes the sine network and control circuitry described above together with biasing and related circuitry which perform in ways understood by those skilled in such art; thus detailed discussions of such operation will be omitted for the sake of simplicity.

Figure 10A:
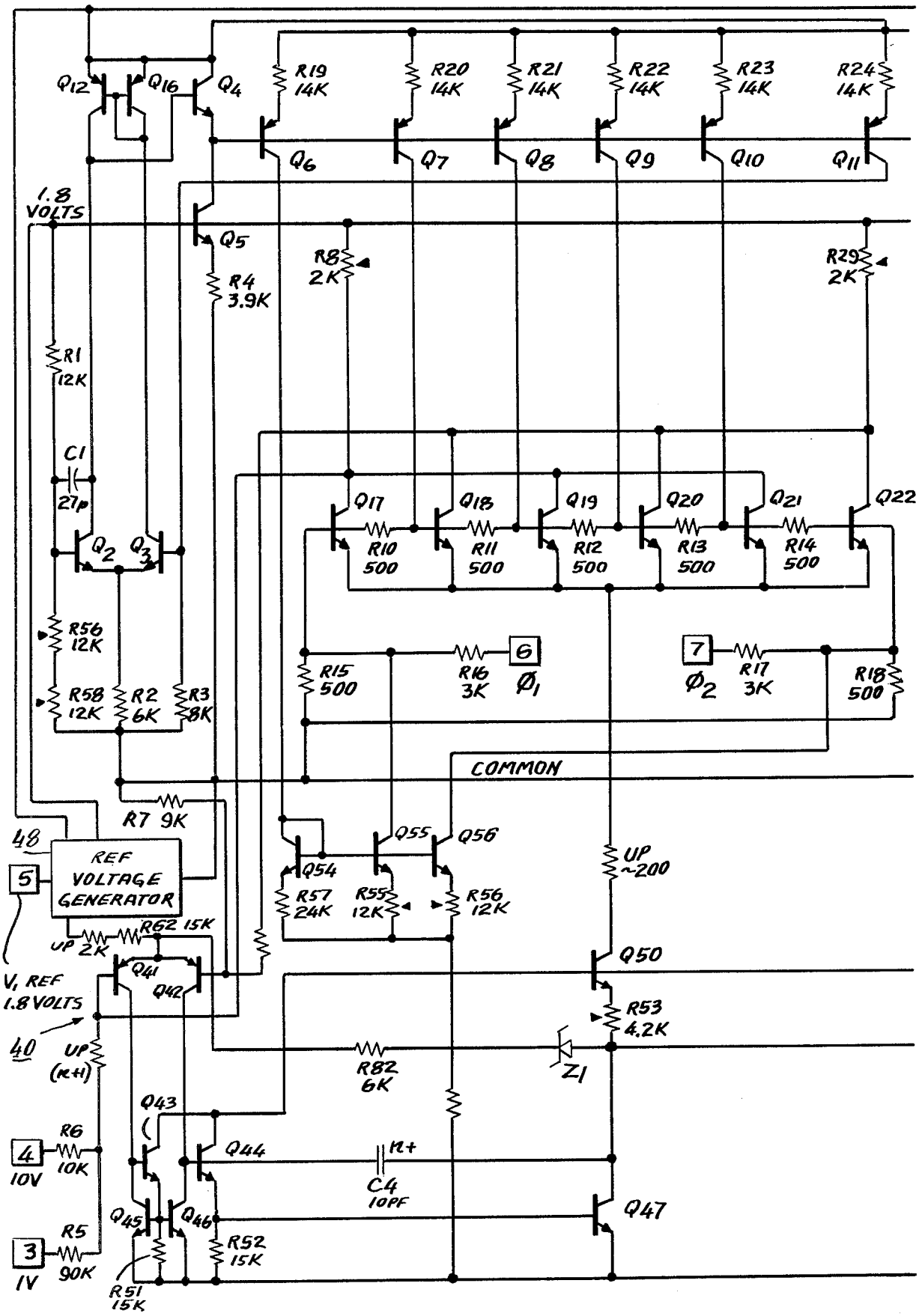
Figure 10B:
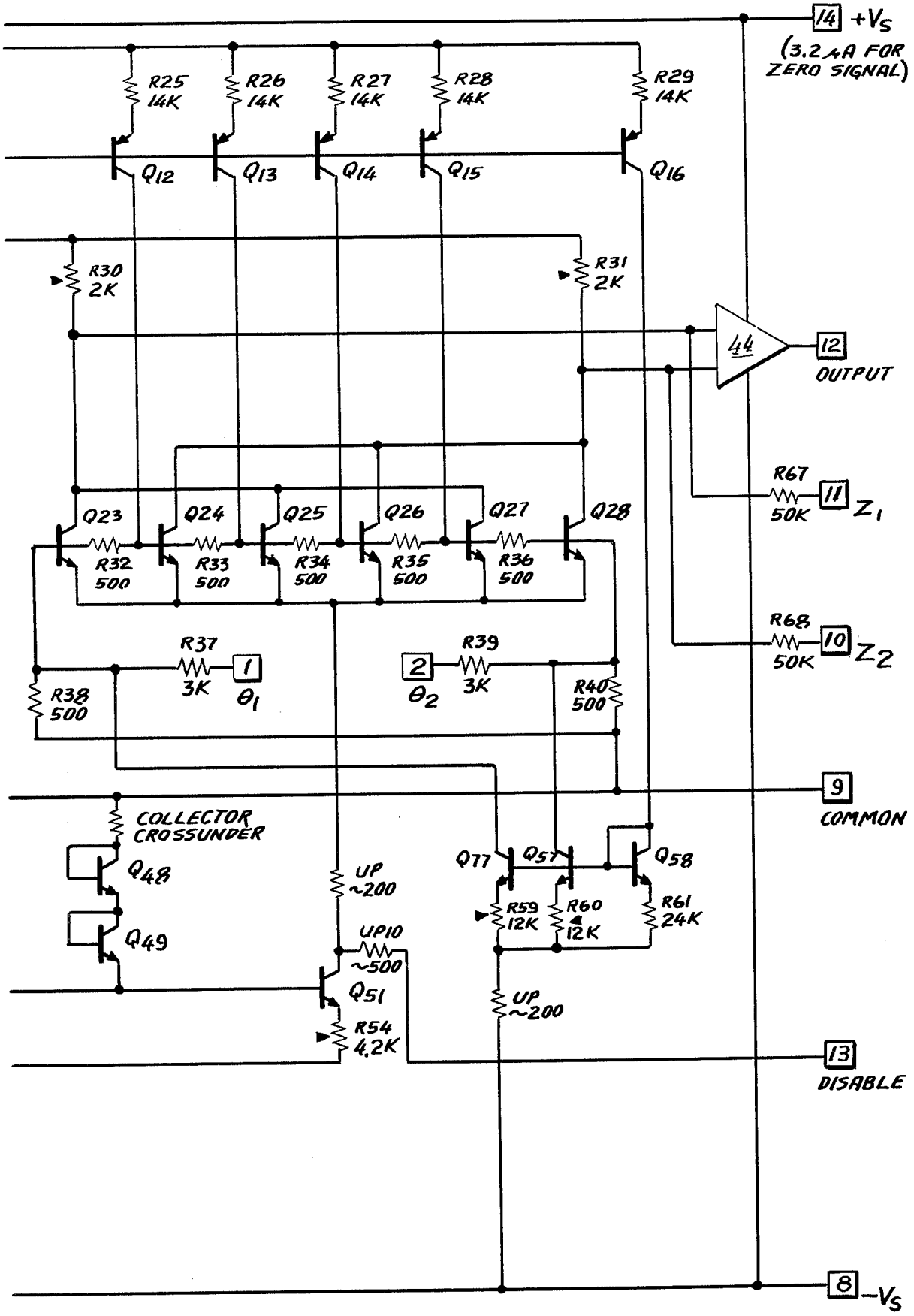

The $\theta$ network 20 is shown on FIG. 10B to include transistors Q23 through Q28, resistors R32 through R36, four 150 μA nodal current-sources Q12 through Q15, and input attenuators R37 through R40. Q23 through Q28 are arranged to exhibit high beta, relatively low base resistance and good $V_{BE}$ matching, and are located as closely as possible in the layout of the chip to minimize thermal errors. The current sources Q12 through Q15 are matched, and have an output impedance of about 1O M.

An extra current-source, Q16 and R29, serves a dual role: first, because it is placed at the outside end of the array of PNPs Q12–Q15, it serves to improve the matching of these devices by acting as a dummy terminator; second, it provides a topologically convenient way to bias Q58, Q77 and Q57. These current mirrors have a gain or two, and provide a sink for the 300 μA which flows out of each end of the base-bias network.

The $\phi$ network 22 shown on FIG. lOA is the same as the $\theta$ network 20, and includes transistors Q17 through Q22, resistors R1O through R14, four 150 μA nodal current sources Q7 through QlO, and input attenuators R15 through R18. The nodal current sources of both networks are controlled by a common control amplifier including Q2, Q3, Q4, and associated circuitry.

Although a preferred embodiment of the invention has been described in detail, it should be understood that this is for the purpose of illustrating the principles of the invention, and that many changes can be made while still remaining within the scope of the invention. For example, although the network emitter sources $I_{E1}$ and $I_{E2}$ have been disclosed as providing equal currents, it will be evident that unequal currents which are caused to track also can be used in achieving the desired end results. Still other modifications will be apparent to those skilled in the art, and for that reason the specific details of the disclosed embodiment are not to be considered as limiting of the invention.

I claim:

1. A trigonometric function generator for selectively producing any of the standard trigonometric functions, compris- ing:

a first sine (cosine) network arranged to receive a first angle input signal and to produce a first output signal responsive to the sine (cosine) of the first input angle;

a second sine (cosine) network arranged to receive a second angle input signal and to produce a second output signal responsive to the sine (cosine) of the second input angle; and circuit means interconnecting said first and second networks and including means to produce a composite output signal therefrom proportional to the sine (cosine) of said first input angle and inversely proportional to the sine (cosine) of said second input angle.

2. Apparatus as claimed in claim 1, wherein said composite output signal is a signal corresponding to said first output signal;

said circuit means comprising means responsive to said second output signal for controlling the operation of said first network to vary said first output signal inversely with changes in said second input angle.

3. Apparatus as claimed in claim 2, including first and second current sources supplying currents to said first and second networks respectively;

said network output signals being derived from the current supplied by the respective current source.

4. Apparatus as claimed in claim 3, including feedback means responsive to said second output signal for controlling said second current source to set said second output signal at a preselected magnitude; and means interconnecting said two current sources to make said second current source track said first current source.

5. Apparatus as claimed in claim 4, wherein said first and second current sources are matched and produce equal currents.

6. Apparatus as claimed in claim 1, wherein said sine networks are arranged to receive differential angle input signals; and means to supply a reference voltage corresponding to an angle of 90° as one component of a differential signal applied to either of said networks.

7. Apparatus as claimed in claim 6, wherein one of said networks is connected to receive on one input terminal thereof a reference signal corresponding to an angle of 90°, to produce a cosine function from that network.

8. Apparatus as claimed in claim 7, wherein the other network produces a sine function in its output, whereby said composite output signal is the tangent (cotangent) function.

9. Apparatus as claimed in claim 1, including a high-gain amplifier having its input coupled to the output of said first network;

means to couple to said amplifier input a signal representing a preselected trigonometric function;

the output of said amplifier being coupled to at least one of the angle inputs of said networks to control the composite output of said networks to a value corresponding to the inverse of said trigonometric function signal, whereby the amplifier output represents the angle corresponding to the preselected trigonometric function.

10. Apparatus as claimed in claim 1, wherein each of said sine networks comprises:

a pair of output terminals;

a set of transistors;

means connecting the collectors of said transistors to the respective output terminals in alternating anti-phase;

a common source of emitter current for said set of transistors;

a base-bias network having a set of nodal points;

means to supply current to said network to develop at said nodal points a voltage distribution pattern having a peak located along the nodal line;

means connecting said nodal points to the bases of said transistors respectively; and input means to apply to said network an input signal proportional to an input angle and to control the positioning of said peak along said nodal line in accordance with the magnitude of the signal.

11. The method of generating trigonometric functions which comprises:

developing a first signal from the output of a first sine (cosine) network arranged to receive a first angle input signal;

developing a second signal from the output of a second sine (cosine) network arranged to receive a second angle input signal; and using said second angle input signal to control the magnitude of said first signal inversely with respect to the magnitude of said second angle.

12. The method of claim 11 wherein said networks are arranged to receive differential angle input signals; and applying to the input of at least one of said networks, as one component of the differential input signal, a reference signal having a value corresponding to an angle of 90°.

13. The method of claim 11, including the step of applying the output of said first network to a high-gain amplifier;

directing the output of said amplifier to at least one of the inputs of said networks; and supplying to the input of said amplifier a function signal to be balanced by the output of said network whereby to produce an inverse trigonometric function.

* * * * *